US009803376B1

(12) United States Patent
Deel

(10) Patent No.: US 9,803,376 B1
(45) Date of Patent: Oct. 31, 2017

(54) DECK SYSTEM AND METHODS OF INSTALLING A DECK

(71) Applicant: Doug Deel, Jackson, MN (US)

(72) Inventor: Doug Deel, Jackson, MN (US)

( * ) Notice: Subject to any disclaimer, the term of this patent is extended or adjusted under 35 U.S.C. 154(b) by 0 days.

(21) Appl. No.: 15/225,385

(22) Filed: Aug. 1, 2016

(51) Int. Cl.
*E04F 15/02* (2006.01)
*E04B 1/00* (2006.01)

(52) U.S. Cl.
CPC ..... *E04F 15/02183* (2013.01); *E04B 1/003* (2013.01); *E04F 15/02038* (2013.01); *E04F 15/02044* (2013.01); *E04F 2015/02066* (2013.01)

(58) Field of Classification Search
CPC ..... E04F 15/02183; E04F 15/02038; E04F 15/02044; E04F 2015/02066; E04B 1/003
See application file for complete search history.

(56) References Cited

U.S. PATENT DOCUMENTS 3,046,852 A * 7/1962 Graham ..... E04C 2/427 52/177
3,100,556 A * 8/1963 De Ridder ..... F16B 5/008 52/283
3,186,525 A * 6/1965 Gresham ..... E04C 2/08 52/579
3,680,530 A * 8/1972 Drawsky ..... E04B 5/10 119/529
3,813,839 A * 6/1974 Simpson, Jr. ..... E04B 5/10 52/394
3,837,319 A * 9/1974 Lehe ..... A01K 1/0151 119/529
5,050,362 A * 9/1991 Tal ..... E04C 2/543 404/41
5,185,193 A * 2/1993 Phenicie ..... B65D 90/026 220/1.5
5,215,802 A * 6/1993 Kaars Sijpesteijn ... A47L 23/24 15/215
5,613,339 A * 3/1997 Pollock ..... B63B 3/48 114/263
5,647,184 A * 7/1997 Davis ..... C08L 23/10 52/100

(Continued)

OTHER PUBLICATIONS

Wahoo Decks, AridDek waterproof deck system, on sale prior to the effective filing date of the present application.

*Primary Examiner* — Babajide Demuren
(74) *Attorney, Agent, or Firm* — Stinson Leonard Street LLP

(57) ABSTRACT

A deck system is provided. The deck system includes a joining strip comprising a first strip connector having a first connector tongue and first connector groove. A plank removably and pressureably is coupled to the first connector, the plank comprising a first plank connector coupled to the plank body, the first plank connector comprising a first plank tongue configured to removably couple to the first connector groove and comprising a first plank groove configured to removably couple to the first connector tongue. A first plank leg is coupled to the first plank connector and comprising an inner channel and an outer channel configured in flow communication with the inner channel, wherein at least one of the inner channel and the outer channel is configured to direct any fluid seepage from the joining strip and the plank away from the joining strip and the plank.

20 Claims, 6 Drawing Sheets

(56) References Cited

U.S. PATENT DOCUMENTS

| | | | | |
|---|---|---|---|---|
| 5,758,467 | A * | 6/1998 | Snear | E04C 2/20 52/177 |
| 5,782,044 | A * | 7/1998 | Dodd | E04F 19/10 345/629 |
| 5,816,010 | A | 10/1998 | Conn | |
| 6,018,925 | A * | 2/2000 | Biro | B63B 5/06 52/177 |
| 6,226,950 | B1 * | 5/2001 | Davis | C08L 23/10 52/100 |
| 8,056,295 | B2 | 11/2011 | Cappelle et al. | |
| 8,276,344 | B2 * | 10/2012 | Hawkins, III | E04B 5/026 52/302.1 |
| 8,291,666 | B1 | 10/2012 | Garrison | |
| 8,833,028 | B2 | 9/2014 | Whispell et al. | |
| 8,997,431 | B2 | 4/2015 | Winter | |
| 2005/0204661 | A1 * | 9/2005 | Showers | E04F 15/10 52/263 |

* cited by examiner

DECK SYSTEM AND METHODS OF INSTALLING A DECK

BACKGROUND

The present disclosure relates to a surface covering, and in particular, a deck system having interlocking planks and joining strips and a method of assembling the deck system.

A deck covering is a structure typically built outdoors and typically connected to a building. A deck usually has a flat surface similar to a floor and can be built at a given elevation above the ground. A deck can support a load consisting of people, deck furniture, or other items. The supportable load can vary from deck to deck based on such items as the size and type of material used to build the deck. Typical deck coverings are made from a wood based material. Wood based deck coverings, however, can be heavy and may not be water resistant or humidity resistant. Some wood-based deck coverings may include, gaps between planks wherein the gaps can create spaces for water to flow underneath the deck covering and/or spaces which can collect debris.

To reduce the spacing between planks, non-wood based deck coverings may use grooved surfaces to connect adjacent planks. Conventional grooved connections, however, may not adequately join together which can result in reduced joint strength and/or result in tripping conditions. Additionally, typical grooved deck coverings may require using a tapping block or other tool which can add installation complexity and/or damage capability to the deck covering. Moreover, typical deck connectors may allow water seepage between deck planks. The water seepage can pool or collect underneath the deck structure. The water collection may result in corrosion issues for the deck components. Further, the water collection can force back up onto the deck surface at other locations which can result in unsightly or unsafe conditions.

Therefore, a deck system that is lightweight but yet durable is desired. A deck system is also desired that can provide rapid, convenient, efficient, and economical design, manufacturing, installation, and maintenance. It is also desired to have a deck system that is water resistant and corrosion resistant while achieving desired or acceptable joint strengths. A deck system is also desired that can effectively handle water seepage such as directing any water seepage away from the deck.

BRIEF DESCRIPTION OF THE DRAWINGS

Features, aspects, and advantages of the present disclosure will become better understood when the following Detailed Description is read with reference to the accompanying drawings in which like characters represent like parts throughout, wherein.

DETAILED DESCRIPTION

Aspects of the present embodiments relate to floor coverings, such as, a deck. The placement and configuration of components of the deck provide the installer with various means for convenient, efficient, and economical installation of the components. The embodiments described herein also provide the installer with a lightweight, but yet durable deck system. Moreover, the embodiments described herein provide for watertight pressure connections among deck components such as joining strips and planks. The deck components are configured to provide desired joint strengths to facilitate a seamless deck arrangement. Additionally, the embodiments described herein provide for directing any water seepage away from the deck. The embodiments described herein include a variety of configurations, and a description and figures that utilize a horizontal deck floor are exemplary only. The exemplary deck system can be used as a freestanding deck positioned on the ground or a deck attached to one or more structures. The deck system, or portions thereof, can be installed on land or in water. The deck system can be easily disassembled from one location, moved to another location, and reassembled at the other location. The deck system may be fabricated from a variety of materials. In the exemplary embodiments, the deck material is fabricated from a metal material such as, but not limited to, aluminum alloy 6063-T6. Alternatively, the material can include any type of material composition including for example only any metal material, non-metal materials, composite materials and/or combinations of materials. The material can be cut from extruded lengths wherein one or more of the extrusions can be mitered, punched, or otherwise repaired to receive fasteners or other deck system components. Moreover, the deck system can be fabricated for a plurality of lengths, widths, thicknesses, and shapes.

Figure 1:
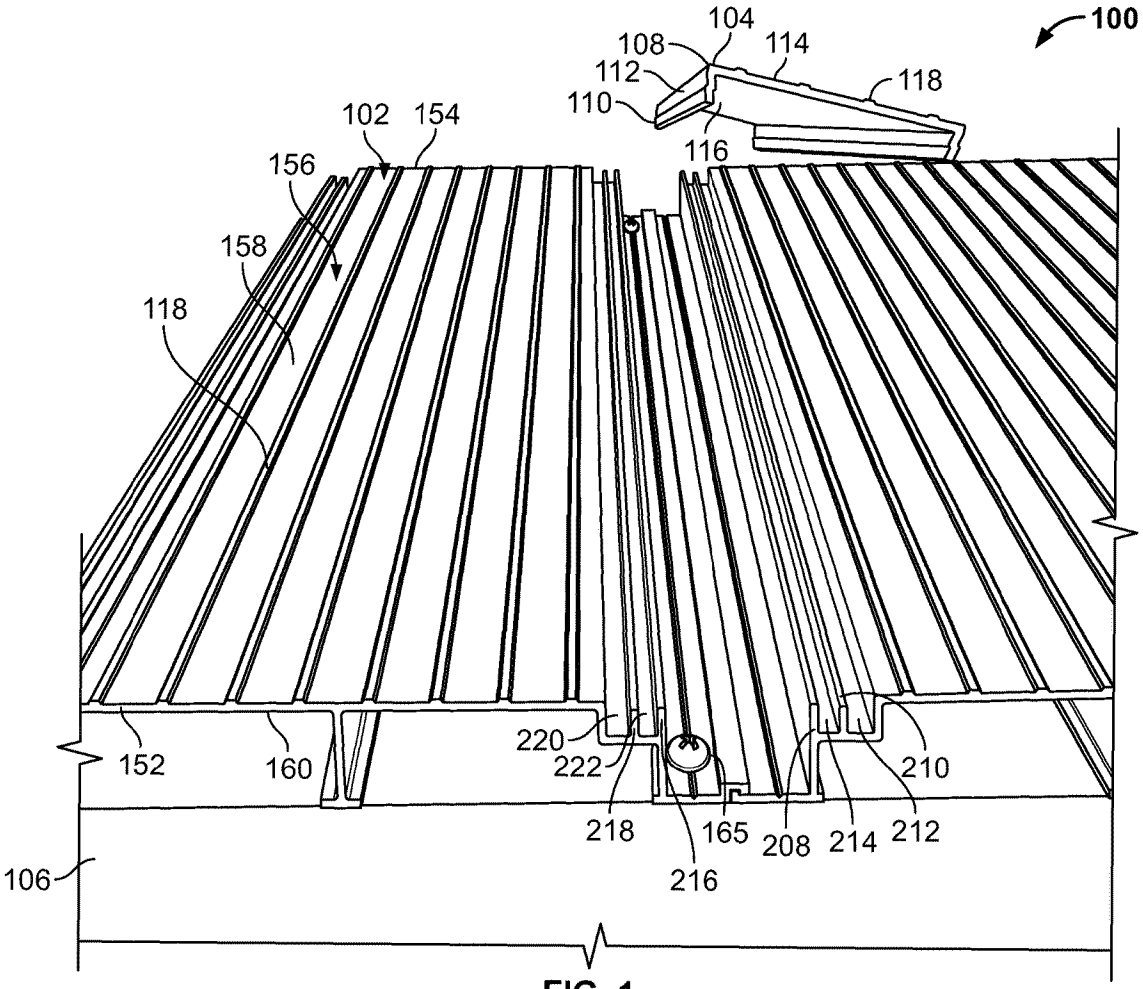
FIG. 1 is a perspective of an exemplary deck system illustrating a plurality of planks and a joining strip of the present disclosure.
Figure 2:
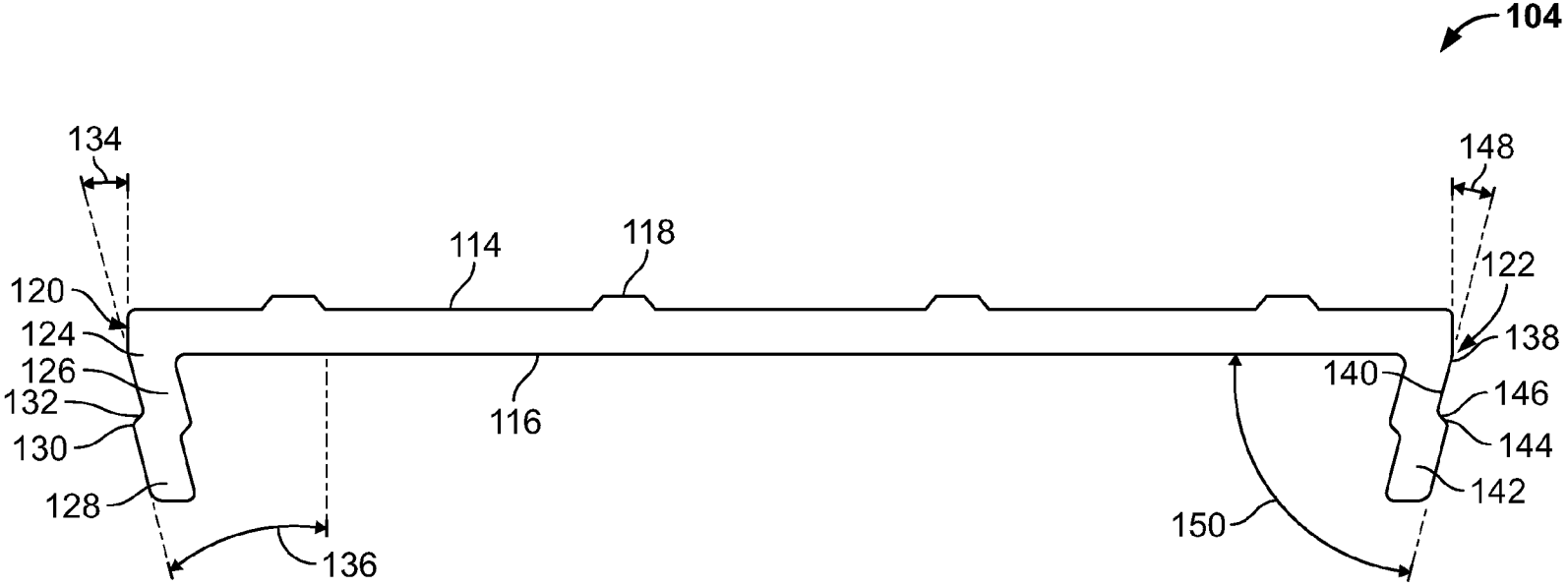
FIG. 2 is a front view of an exemplary joining strip shown in FIG. 1.
Figure 3:
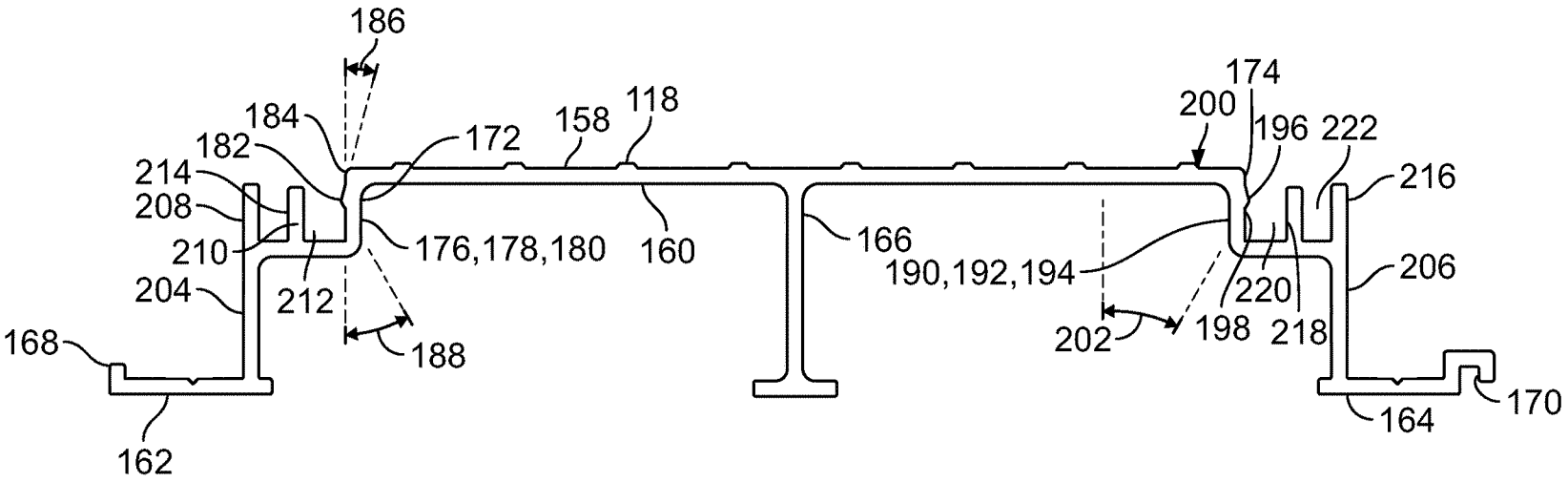
FIG. 3 is a front view of an exemplary plank shown in FIG. 1.

FIG. 1 is a perspective view of a deck system 100 which includes a plurality of planks 102, a joining strip 104, and a foundation 106. FIG. 2 is a front view of the strip 104. FIG. 3 is a front view of the plank 102. In the exemplary embodiment, the plurality of strips 104 are removably and pressureably coupled to adjacent planks 102 of the plurality of planks 102. The foundation 106 can include a plurality of structures such as, but not limited to, a building, a support, and the ground. The planks 102 are removably coupled to each other and to the foundation 106. Each strip 104 includes a first end 108, a second end 110, and a body 112 extending between the first end 108 and the second end 110. The body 112 includes an outer surface 114 and an inner surface 116 wherein the outer surface 114 includes at least one projection 118 or dimple that extends beyond the outer surface 114. The outer surface 114 is exposed to the user, and the projection 118 is configured for traction purposes. The body 112 has a length, as measured between the first end 108 and the second end 110, from about an inch to about 20 feet; and has a thickness, as measured between the outer surface 114 and the inner surface 116, from about 0.01 inches to about 0.5 inches, preferably about 0.07 inches. Additionally, the joining strip 104 has a width from about 0.25 inches to about 6 inches, and preferably about 2 inches. The strip 104 can include any dimensioning to enable the deck system 100 to function as described herein. The size and the shape of adjoining strips 104 are configured to facilitate a lightweight, durable, and usable component for the deck system 100.

The strip 104 further includes a first sidewall 120 and a second sidewall 122 which are configured to extend outward and beyond from the inner surface 116. The first sidewall 120 further includes a first connector 124. The first connector 124 includes a first portion 126 and a second portion 128 that is integrally coupled thereto in an offset position. The first portion 126 and the second portion 128 are positioned offset to facilitate forming a first tongue 130 and a first groove 132. More particularly, the first portion 126 is angled at a first angle 134 relative to the outer surface 114 and the second portion 128 is angled at a second angle 136 relative to the outer surface 114. The first angle 134 is less than the second angle 136. More particularly, the first angle 134 is from about 5 degrees to about 35 degrees, and preferably about 15 degrees. The second angle 136 is from about 25 degrees to about 65 degrees, and preferably about 45 degrees. Alternatively, the first angle 134 can be about the same or larger than the second angle 136. The first angle 134 and second angle 136 are selectively determined to form the first tongue 130 and the first groove 132 to facilitate removably and pressureably coupling to the planks 102.

The second sidewall 122 further includes a second connector 138. The second connector 138 includes another first portion 140 and another second portion 142 integrally coupled thereto in an offset position. The first portion 140 and second portion 142 are positioned offset to facilitate forming a second tongue 144 and a second groove 146. More particularly, the first portion 140 is angled at a first angle 148 relative to the outer surface 114 and the second portion 142 is angled at a second angle 150 relative to the outer surface 114. The first angle 148 is less than the second angle 150. More particularly, the first angle 148 is from about 5 degrees to about 35 degrees, and preferably about 15 degrees. The second angle 150 is from about 25 degrees to about 65 degrees, and preferably about 45 degrees. Alternatively the first angle 148 can be about the same or larger than the second angle 150. The first angle 148 and the second angle 150 are selectively determined to form the second tongue 144 and the second groove 146 to facilitate removably and pressureably coupling to the planks 102.

Each plank 102 of the plurality of planks 102 includes a plank first end 152, a plank second end 154, and a plank body 156 extending between the plank first end 152 and the plank second end 154. The plank body 156 further includes a plank outer surface 158 and a plank inner surface 160, wherein the plank outer surface 158 includes at least one projection 118 or dimple that extends outward and beyond the plank outer surface 158. The plank outer surface 158 is exposed to the user and the projection 118 is configured for traction purposes. The plank body 156 has a length, as measured between the plank first end 152 and the plank second end 154, from about 1 inch to about 20 feet. The plank body 156 has a thickness as measured between the plank outer surface 158 and the plank inner surface 160 from about 0.01 inches to about 0.5 inches, and preferably about 0.07 inches. The plank 102 has a width from about 1 inch to about 12 inches, and preferably about 4.9 inches. The plank 102 can include any dimensioning to enable the deck system 100 to function as described herein. The shape and size of the plank 102 are configured to facilitate a lightweight, durable, and usable component for the deck system 100.

The plank 102 includes a plank first support 162, a plank second support 164, and an intermediate plank support 166 that is selectively positioned between the plank first support 162 and the plank second support 164. The plank supports 162, 164, and 166 are coupled to the plank body 156. In the exemplary embodiment, the plank supports 162, 164, and 166 are integrally coupled to the plank body 156 as being formed from the same material piece. Alternatively, the plank supports 162, 164, and 166 can be removably coupled to the plank body 156. The plank supports 162, 164, and 166 are removably coupled to the foundation 106 via fasteners 165 (shown in FIG. 4) such as, for example only, screws. The plank first support 162 includes a support projection 168 extending outward; and, the plank second support 164 includes a support groove 170. The support groove 170 is configured to receive and removably couple to the support projection 168 of an adjacent plank first second support 162 as described herein.

The plank 102 further includes a first plank sidewall 172 and a second plank sidewall 174 which are configured to extend outward and beyond the plank inner surface 160. The first plank sidewall 172 further includes a first plank connector 176. The first plank connector 176 includes a first portion 178 and a second portion 180 integrally coupled thereto in an offset position. The first portion 178 and the second portion 180 are positioned offset to facilitate forming a first plank tongue 182 and a first plank groove 184. More particularly, the first portion 178 is angled at a first angle 186 relative to the plank outer surface 158 and the second portion 180 is angled at a second angle 188 relative to the plank outer surface 158. The first angle 186 is less than the second angle 188. More particularly, the first angle 186 is from about 5 degrees to about 35 degrees, and preferably about 15 degrees. The second angle 188 is from about 25 degrees to about 65 degrees, and preferably about 45 degrees. Alternatively, the first angle 186 can be about the same or larger than the second angle 188. The first angle 186 and the second angle 188 are selectively determined to form the plank tongue and the plank groove to facilitate removably and pressureably coupling to the strip.

The second plank sidewall 174 further includes a second plank connector 190. The second plank connector 190 includes another first portion 192 and another second portion 194 integrally coupled thereto in an offset position. The first portion 192 and the second portion 194 are positioned offset to facilitate forming a second plank tongue 196 and a second plank groove 198. More particularly, the first portion 192 is angled at a first angle 200 relative to the plank outer surface 158 and the second portion 194 is angled at a second angle 202 relative to the plank outer surface 158. The first angle 200 is less than the second angle 202, more particularly, the first angle 200 is from about 5 degrees to about 35 degrees, and preferably about 15 degrees. The second angle 202 is from about 25 degrees to about 65 degrees, and preferably about 45 degrees. Alternatively, the first angle 200 can be about the same or larger than the second angle 202. The first angle 200 and the second angle 202 are selectively determined to form the second plank tongue 196 and the second plank groove 198 to facilitate removably and pressureably coupling to the strip.

Still further, each plank 102 of the plurality of planks 102 includes a first leg 204 and a second leg 206. The first leg 204 is coupled to the plank first support 162 and the first plank sidewall 172. The second leg 206 is coupled to the plank second support 164 and the second plank sidewall 174. The first leg 204 includes an outer wall 208 and an inner wall 210. The outer wall 208 has a height that is longer than a height of the inner wall 210. Alternatively, the outer wall 208 can be substantially the same height or less than the inner wall 210 height. The inner wall 210 is selectively positioned between the outer wall 208 and the first plank sidewall 172. The selective position of the inner wall 210 relative to the first plank sidewall 172 and the outer wall 208 is configured to form an inner channel 212 and an outer channel 214. The inner channel 212 is positioned between the first plank sidewall 172 and the inner wall 210 while the outer channel 214 is positioned between the outer wall 208 and inner wall 210. The inner channel 212 are configured to extend longitudinally along the length of the plank body 156 between the plank first end 152 and the plank second end 154. The inner channel 212 outer channel 21'1 is configured to receive the second connector 138 of the strip 102 as described herein. The inner channel 212 is configured to receive fluid seepage such as, for example only, water seeping from the strip outer surface 114 and/or the plank outer surface 158 as described herein.

The second leg 206 includes another outer wall 216 and another inner wall 218. The outer wall 216 has a height that is longer than the height of the inner wall 218. Alternatively, the outer wall 216 can be substantially the same or less than the inner wall 218 height. The inner wall 218 is selectively positioned between the outer wall 216 and the second plank sidewall 174. The selective positioning of the inner wall 218 relative to the second plank sidewall 174 and the outer wall 216 is configured to form another inner channel 220 and another outer channel 222. The inner channel 220 is positioned between the second plank sidewall 174 and the inner wall 218 while the outer channel 222 is positioned between the outer wall 216 and the inner wall 218. The inner channel 220 and the outer channel 222 are configured to extend longitudinally along the length of the plank body 156 between the plank first end 152 and the plank second end 154. The inner channel 220 is configured to receive the first connector 124 of the strip 104 as described herein. The inner channel 220 is configured to receive fluid seepage such as, for example only, water present on the strip outer surface 114 and/or the plank outer surface 158 as described herein.

Figure 4:
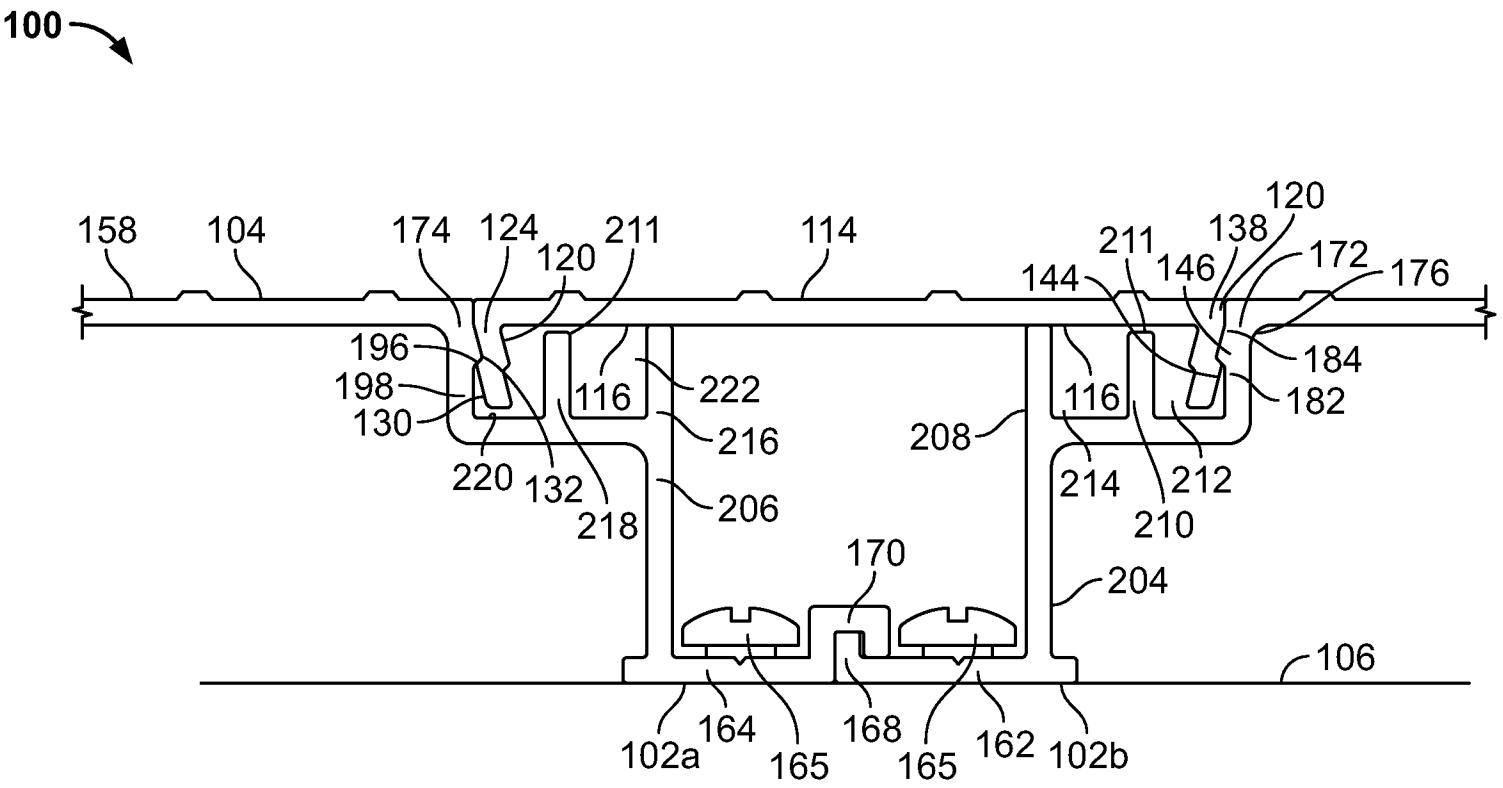
FIG. 4 is a front view of the joining strip coupled to adjacent planks.

FIG. 4 is a front view of the strip 104 removably coupled to a pair of adjacent planks 102*a*, 102*b*. As illustrated, the adjacent planks 102*a*, 102*b* are removably coupled to each other and to the foundation 106. More particularly, the support groove 170 is configured to removably and pressureably receive the support projection 168 of adjacent plank 102*b*. Additionally, the support projection 168 of plank 102*b* is configured to insert into the support groove 170. As shown, the plank first support 162 is removably coupled to the foundation 106 by the fastener 165 such as, but not limited to, a screw. The second plank support 164 is also removably coupled to the foundation 106 by a fastener 165.

In the exemplary embodiment, the first connector 124 of the strip first sidewall 120 is configured to pressureably couple to the second plank sidewall 174 of plank 102*a*. More particularly, the first connector 124 is configured to removably and pressureably insert into the inner channel 220 of the second leg 206 of plank 102*a*. The second plank tongue 196 of the second plank connector 190 is pressureably coupled to the first groove 132 of the first connector 124. Additionally, the first tongue 130 of the first connector 124 is pressureably coupled to the second plank groove 198 of the second plank connector 190. When pressureably coupled together, the first connector 124 and the second plank connector 190 are configured to facilitate forming a pressurized interface between the first sidewall 120 of the strip 104 and the second plank sidewall 174.

In the exemplary embodiment, the second connector 138 of the strip second sidewall 122 is configured to pressureably couple to the first plank sidewall 172 of plank 102*b*. More particularly, the second connector 138 is configured to removably and pressureably insert into the inner channel 212 of the first leg 204 of plank 102*b*. The first plank tongue 182 of the first plank connector 176 is pressureably coupled to the second groove 146 of the second connector 138. Additionally, the second tongue 144 of the second connector 138 is pressureably coupled to the first plank groove 184 of the first plank connector 176. When pressureably coupled together, the second connector 138 and the first plank connector 176 are configured to facilitate forming a pressurized interface between the second sidewall 122 of the strip 104 and the first plank sidewall 172.

As shown for the first leg 204, since the height of inner wall 210 is less than the height of outer wall 208, a gap 211 is formed between the inner wall 210 and the strip inner surface 116. As structured, the inner channel 212 and the outer channel 214 are in flow communication with each other. The pressurized interface is configured to reduce and/or eliminate any fluid such as water that is present on strip outer surface 114 and/or plank outer surface 158 from flowing in between the planks 102 and the strips 104. If any fluid seeps or flows from the outer surfaces 114, 158 and through the pressurized interface, the fluid can collect in the inner channel 212. If the inner channel 212 reaches fluid capacity, the gap 211 is configured to direct the fluid from inner channel 212 and into the outer channel 214. The outer channel 214 is configured to direct any fluid seepage toward at least one of the plank first end 152 and the plank second end 154. The outer channel 214 is configured to direct any fluid seepage away from the strip outer surface 114 and the plank outer surface 158 to facilitate reducing and/or eliminating fluid buildup below surface and/or fluid pressuring up onto other surfaces.

As shown for the second leg 206, since the height of inner wall 218 is less than the height of outer wall 216, the gap 211 is formed between the inner wall 218 and the strip inner surface 116. As structured, the inner channel 220 and the outer channel 222 are in flow communication with each other. The pressurized interface is configured to reduce and/or eliminate any fluid such as water that is present on strip outer surface 114 and/or plank outer surface 158 from flowing in between the planks 102 and the strips 104. If any fluid seeps or flows from the outer surfaces 114, 158 and through the pressurized interface, the fluid can collect in the inner channel 220. If the inner channel 220 reaches fluid capacity, the gap 211 is configured to direct the fluid from inner channel 220 and into the outer channel 222. The outer channel 222 is configured to direct any fluid seepage toward at least one of the plank first end 152 and the plank second end 154. The outer channel 222 is configured to direct any fluid seepage away from the strip outer surface 114 and the plank outer surface 158 to facilitate reducing and/or eliminating fluid buildup below surface and/or fluid pressuring up onto other surfaces.

Figure 5:
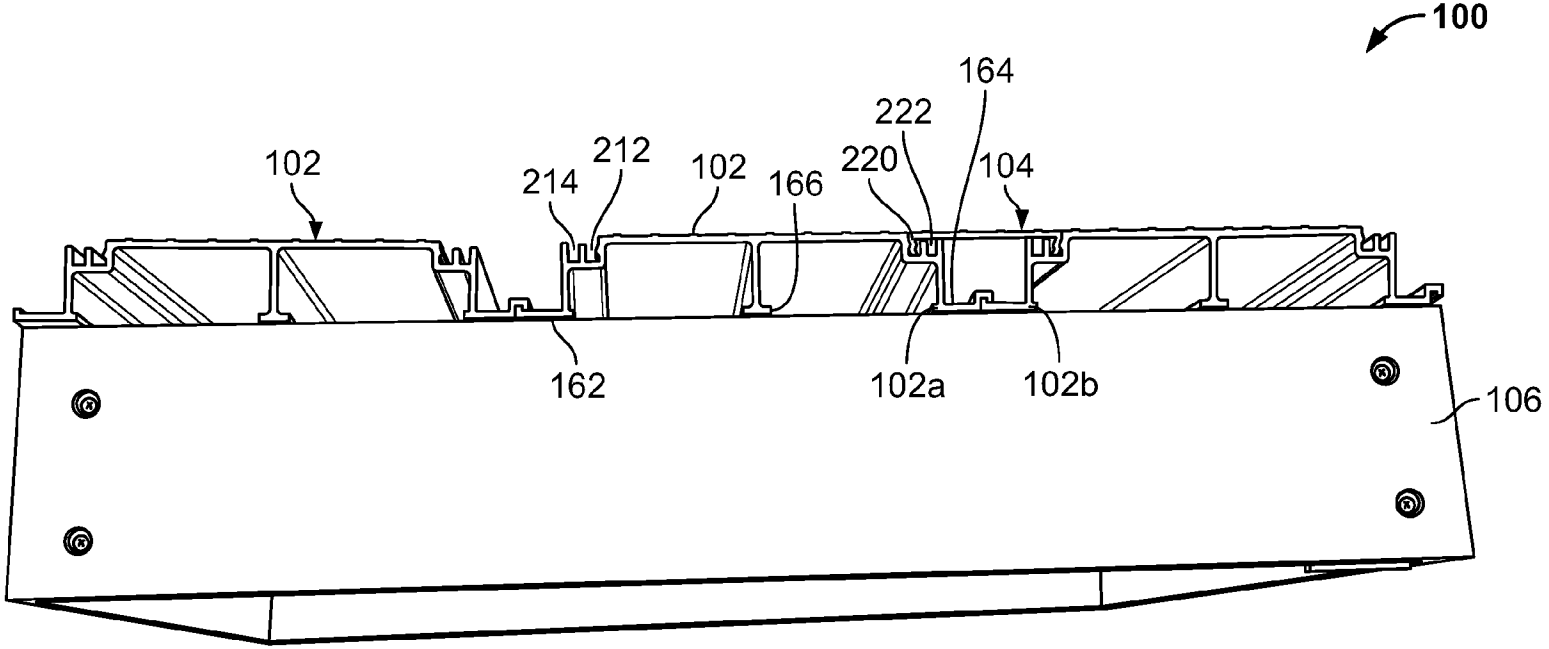
FIG. 5 is another front view of the joining strip coupled to adjacent planks when the planks are coupled to a foundation.
Figure 6:
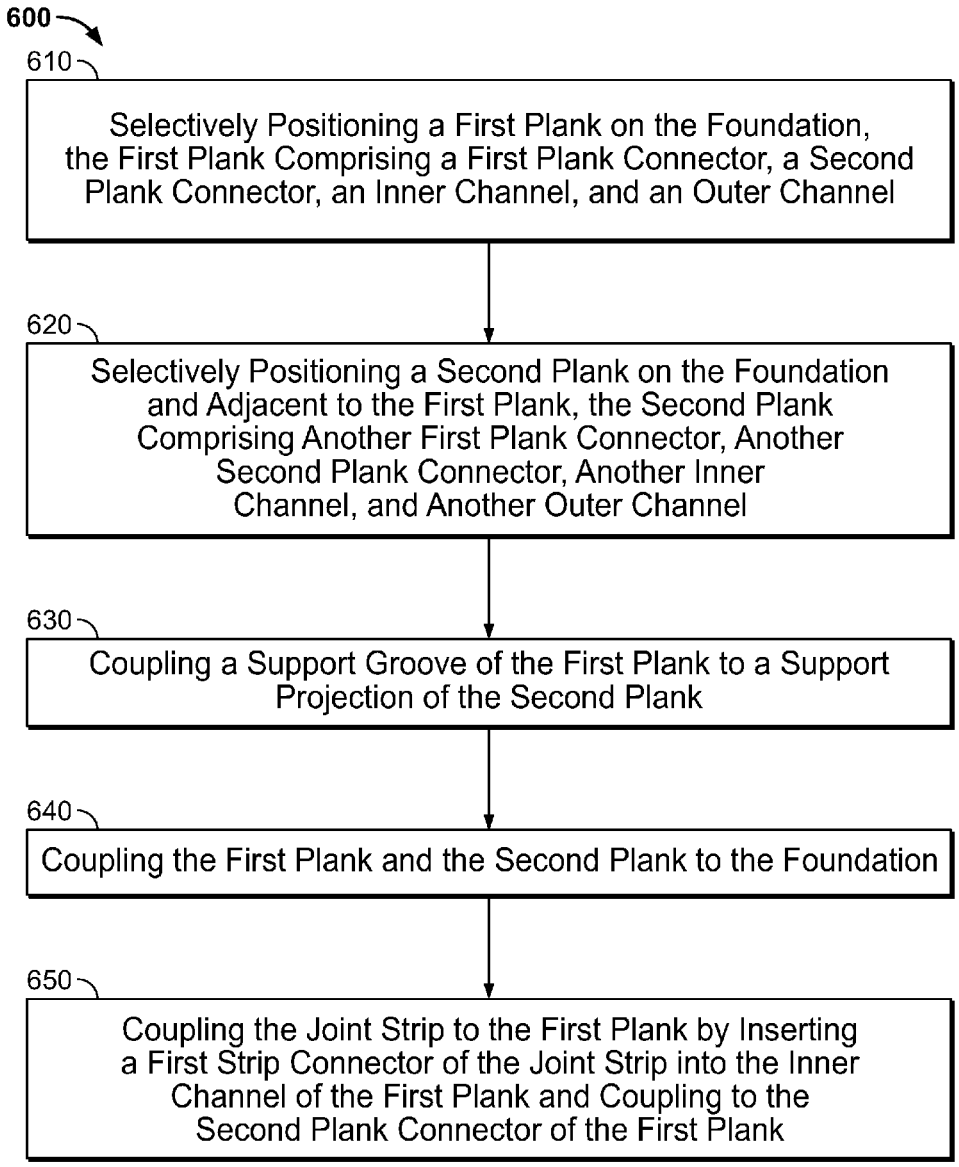
FIG. 6 is a flowchart illustrating an exemplary method of installing the deck system shown in FIG. 1.

FIG. 5 is another front view of the joining strip 104 coupled to adjacent planks 102*a*, 102*b* wherein the planks 102*a*, 102*b* are coupled to the foundation 106. FIG. 6 is a flowchart illustrating an exemplary method of installing the deck system shown in FIG. 1. Turing to FIGS. 5 and 6, and referring to FIGS. 1-4, during a method 600 of installing the deck system 100 to the foundation 106, an installer selectively positions 610 the first plank 102*a* on the foundation 106. The second plank 102*b* is also selectively 620 positioned on the foundation 106 and adjacent to the first plank 102*a*. The installer places the first plank support 162, second plank support 164, and the plank intermediate support 166 of the respective first plank 102*a* and the second plank 102*b* against the foundation 106. In these positions, the inner channels 212, 220 and the outer channels 214, 222 are exposed to the installer. In positioning the second plank

102*b*, the support projection 168 extends away from the foundation 106. In positioning the first plank 102*a*, the support groove 170, removably couples 630 to the support projection 168. The installer couples the first plank 102*a* and the second plank 102*b* to the foundation 106. In an embodiment, the installer fastens 640 the first plank support 162 and plank second support 164 to the foundation 106 by the fastening screws 165.

The joining strip 104 is removably and pressureably coupled 650 to the first plank 102*a* and the second plank 102*b*. During an exemplary installation, the first connector 124 of the strip 104 is inserted into the inner channel 220 of the second leg 206 of plank 102*a*. The installer pressureably couples the first connector 124 to the second plank sidewall 174 of plank 102*a* wherein the second plank tongue 196 of the second plank connector 190 is pressureably coupled to the first groove 132 of the first connector 124. Additionally, the first tongue 130 of the first connector 124 is pressureably coupled to the second plank groove 198 of the second plank connector.

Additionally, during an exemplary installation, the second connector 138 of the strip 104 is inserted into the inner channel 212 of the first leg 204 of plank 102*b*. The installer pressureably couples the second connector 138 to the first plank sidewall 172 of plank 102*b* wherein the first plank tongue 182 of the first plank connector 176 is pressureably coupled to second groove of the second connector 138. Additionally, the second tongue 144 of the second connector 138 is pressureably coupled to the first plank groove 184 of the first plank connector 176.

The pressurized coupling of the strip 104 and the adjacent planks 102*a*, 102*b* forms the pressurized interface among the strip 104 and the planks 102*a*, 102*b* to facilitate reducing and/or eliminating any fluid seepage for example water to flow from the outer surface 114 of the strip 104 and/or the outer surface 158 of the planks 102 and through the pressurized interface. Should any fluid seepage pass through the pressurized interface, the fluid is directed to the inner channels 212, 220. The inner channels 212, 220 collect the fluid seepage and direct the fluid seepage through and beyond at least one of the strip first end 108, the strip second end 110, the plank first end 152, and the plank second end 154. Moreover, the fluid seepage can flow from the inner channels 212, 220 through the gap 211 (for example over the inner walls 210, 218) and into the respective outer channels 214, 222. The outer channels 214, 222 can collect the fluid seepage and direct the fluid seepage through and beyond at least of the strip first end 108, strip second end 110, the plank first end 152, and the plank second end 154.

Exemplary embodiments of a deck system closure are described herein. The methods and assemblies are not limited to the specific embodiments described herein, but rather, components of assemblies and/or steps of the methods may be utilized independently and separately from other components and/or steps described herein. For example, the methods may also be used in combination with other assemblies and methods, and are not limited to practice with only the assemblies and methods described herein. Rather, the exemplary embodiments may be implemented and utilized in connection with many floor systems and building structures.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention and also to enable any person skilled in the art to practice the invention, including making and using devices or assemblies or systems and performing any incorporated method. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A deck system comprising:

a plurality of planks each comprising:

a plank first end;

a plank second end;

a plank body extending between the plank first end and the plank second end, wherein the plank body comprises a plank outer surface;

a first plank support coupled to the plank body;

a second plank support coupled to the plank body, wherein the second plank support of at least one of the plurality of planks removably engages the first plank support of another of the plurality of planks;

a first channel positioned between the plank body and the first plank support, wherein the first channel is configured to direct fluid toward at least one of the plank first end and the plank second end; and a second channel positioned between the plank body and the second plank support, wherein the second channel is configured to direct fluid toward at least one of the plank first end and the plank second end, wherein the plank outer surface is substantially continuous and planar from the plank first end to the plank second end, and wherein the plank outer surface is substantially continuous and planar from the first channel to the second channel; and a plurality of joining strips each removably coupled to an adjacent pair of the plurality of planks, wherein each of the joining strips covers the first plank support of one of the plurality of planks, wherein each of the joining strips covers the second plank support of another of the plurality of planks, and wherein at least a portion of the plank outer surface of each of the plurality of planks is uncovered by the plurality of joining strips.

2. The deck system of claim 1, wherein the first plank support comprises a support projection, wherein the second plank support comprises a support groove, and wherein the support groove of at least one of the plurality of planks receives and is removably coupled to the support projection of another of the plurality of planks.

3. The deck system of claim 1, wherein each of the plurality of planks further comprises a first plank sidewall coupled to the plank body, and a first leg coupled to the first plank support and the first plank sidewall, and wherein the first channel is formed by the first plank sidewall and the first leg.

4. The deck system of claim 3, wherein the first plank sidewall comprises a first plank connector that removably engages one of the plurality of joining strips.

5. The deck system of claim 4, wherein the first plank connector comprises a first plank tongue and a first plank groove.

6. The deck system of claim 5, wherein each of the plurality of joining strips comprises a tongue that is received by the first plank groove of one of the plurality of planks and a groove that receives the first plank tongue of one of the plurality of planks.

7. The deck system of claim 3, wherein each of the plurality of planks further comprises a second plank sidewall coupled to the plank body, and a second leg coupled to the second plank support and the second plank sidewall, and wherein the second channel is formed by the second plank sidewall and the second leg.

8. The deck system of claim 1, wherein each of the plurality of joining strips comprises a first end, a second end, a body extending between the first end and the second end and comprising an outer surface, a first sidewall that is coupled to the body, and a second sidewall that is coupled to the body.

9. The deck system of claim 8, wherein the first sidewall comprises a first connector that removably engages one of the plurality of planks, and wherein the second sidewall comprises a second connector that removably engages another of the plurality of planks.

10. The deck system of claim 8, wherein the outer surface of each of the plurality of joining strips is substantially continuous and planar from the first end to the second end, and wherein the outer surface of each of the plurality of joining strips is substantially continuous and planar from the first sidewall to the second sidewall.

11. The deck system of claim 10, wherein the outer surface of each of the plurality of joining strips is substantially flush with the plank outer surface of each of the plurality of planks.

12. The deck system of claim 1, wherein each of the joining strips covers at least a portion of the first channel of one of the plurality of planks, and wherein each of the joining strips covers at least a portion of the second channel of another of the plurality of planks.

13. A deck system comprising:

a plurality of planks each comprising:

a plank first end;

a plank second end;

a plank body extending between the plank first end and the plank second end, wherein the plank body comprises a plank outer surface;

a first plank support coupled to the plank body;

a second plank support coupled to the plank body, wherein the second plank support of at least one of the plurality of planks removably engages the first plank support of another of the plurality of planks;

a first channel positioned between the plank body and the first plank support, wherein the first channel is configured to direct fluid toward at least one of the plank first end and the plank second end; and a second channel positioned between the plank body and the second plank support, wherein the second channel is configured to direct fluid toward at least one of the plank first end and the plank second end, wherein the plank outer surface is substantially continuous and planar from the plank first end to the plank second end, and wherein the plank outer surface is substantially continuous and planar from the first channel to the second channel; and a plurality of joining strips each removably coupled to an adjacent pair of the plurality of planks and comprising:

a first end;

a second end;

a body extending between the first end and the second end and comprising an outer surface, wherein the body covers the first plank support of one of the plurality of planks, and wherein the body covers the second plank support of another of the plurality of planks;

a first sidewall that is coupled to the body, wherein the first sidewall comprises a first connector that removably engages one of the plurality of planks; and a second sidewall that is coupled to the body, wherein the second sidewall comprises a second connector that removably engages another of the plurality of planks, and wherein at least a portion of the plank outer surface of each of the plurality of planks is uncovered by the plurality of joining strips.

14. The deck system of claim 13, wherein the first plank support comprises a support projection, wherein the second plank support comprises a support groove, and wherein the support groove of at least one of the plurality of planks receives and is removably coupled to the support projection of another of the plurality of planks.

15. The deck system of claim 13, wherein each of the plurality of planks further comprises a first plank sidewall coupled to the plank body, and a first leg coupled to the first plank support and the first plank sidewall, and wherein the first channel is formed by the first plank sidewall and the first leg.

16. The deck system of claim 15, wherein the first plank sidewall comprises a first plank connector that removably engages the first connector of one of the plurality of joining strips.

17. The deck system of claim 16, wherein each of the plurality of planks further comprises a second plank sidewall coupled to the plank body, and a second leg coupled to the second plank support and the second plank sidewall, and wherein the second channel is formed by the second plank sidewall and the second leg.

18. The deck system of claim 17, wherein the second plank sidewall comprises a second plank connector that removably engages the second connector of another of the plurality of joining strips.

19. The deck system of claim 13, wherein the outer surface of each of the plurality of joining strips is substantially continuous and planar from the first end to the second end, and wherein the outer surface of each of the plurality of joining strips is substantially continuous and planar from the first sidewall to the second sidewall.

20. The deck system of claim 19, wherein the outer surface of each of the plurality of joining strips is substantially flush with the plank outer surface of each of the plurality of planks.

* * * * *